US006827226B2

(12) United States Patent
Coulson

(10) Patent No.: US 6,827,226 B2
(45) Date of Patent: Dec. 7, 2004

(54) STORAGE APPARATUS FOR SPORTBOARDS WITH VARIABLE WIDTHS

(75) Inventor: Wilmot Maxwell Coulson, Calgary (CA)

(73) Assignee: WMC Holdings Incorporated (CA)

( * ) Notice: Subject to any disclaimer, the term of this patent is extended or adjusted under 35 U.S.C. 154(b) by 0 days.

(21) Appl. No.: 10/314,206

(22) Filed: Dec. 9, 2002

(65) Prior Publication Data

US 2004/0108286 A1 Jun. 10, 2004

(51) Int. Cl.[7] ..... A47F 7/00
(52) U.S. Cl. ..... 211/85.7; 211/70.5
(58) Field of Search ..... 211/89.01, 85.7, 211/66, 70.5, 175, 183; D6/552; 248/316.2, 316.4, 316.6, 323, 325, 274.1, 448, 451

(56) References Cited

U.S. PATENT DOCUMENTS 2,767,854 A * 10/1956 Barrett ..... 211/85.7
3,091,011 A * 5/1963 Campbell ..... 280/814
3,178,141 A * 4/1965 Bloom ..... 248/113
3,836,058 A * 9/1974 Penniman et al. ..... 224/315
4,108,312 A * 8/1978 Craven ..... 211/85.7
4,731,376 A * 3/1988 Hideg et al. ..... 514/423
4,763,797 A * 8/1988 Egan ..... 211/70.5
4,793,496 A * 12/1988 Wait ..... 211/70.5
4,798,298 A * 1/1989 Ursetta ..... 211/70.5
5,024,408 A * 6/1991 Magee ..... 248/206.5
5,035,389 A 7/1991 Wang
5,141,116 A * 8/1992 Mojica ..... 211/60.1
5,183,164 A * 2/1993 Heinzle ..... 211/70.5
5,226,625 A 7/1993 Hanna
5,417,335 A * 5/1995 White ..... 211/70.5
5,580,024 A * 12/1996 Briee ..... 248/444
5,601,196 A 2/1997 Heer et al.
5,788,202 A * 8/1998 Richter ..... 248/316.4
5,799,915 A 9/1998 Morey
5,826,908 A * 10/1998 McBride ..... 280/814
6,196,397 B1 * 3/2001 Maher ..... 211/85.7
6,273,272 B1 * 8/2001 Hake ..... 211/4
6,640,978 B2 * 11/2003 Reiser et al. ..... 211/4

* cited by examiner

*Primary Examiner*—Jennifer E. Novosad
(74) *Attorney, Agent, or Firm*—Bennett Jones LLP

(57) ABSTRACT

The apparatus comprises two gripping members, with a distance between them that is greater than the minimum width of the sportboard that is to be held therein, and lesser than the maximum width of the sportboard. A narrow part of the sportboard is placed between the two gripping members, and the sportboard is lowered until a wider part rests on the gripping member. The edges of the gripping members grip the board and hold it in the apparatus. The distance between the gripping member may be adjustable, to hold boards of different sizes. The apparatus may have a center member with gripping edges, which functions to divide in two the space between the gripping members so that a pair of skis can be held in the apparatus. The apparatus is particularly useful for the storage of snowboards and skis.

26 Claims, 7 Drawing Sheets

STORAGE APPARATUS FOR SPORTBOARDS WITH VARIABLE WIDTHS

FIELD OF THE INVENTION

This invention relates to an apparatus for the storage of sports equipment and, in particular snowboards and skis.

BACKGROUND OF THE INVENTION

The proper storage of sportboards, such as snowboards and skis is necessitated by the fact that if these items are not properly stored they may injure persons, they may become damaged, or the surrounding area may become damaged. Because of their generally unusual shapes, sizes or characteristics many sportboards can not generally be satisfactorily stored on shelves. If leaned against a wall, they tend to fall over because of their rounded ends, and they therefore pose a hazard to anyone nearby who might be hit by the falling equipment, or to someone who later trips over it.

For these reasons, a storage apparatus for sportboards, which apparatus provides a means to stably and securely store the board, is required. This apparatus should be adaptable to different sizes of sportboards, and it should be simple to manufacture, install and use.

SUMMARY OF THE INVENTION

There is provided a storage apparatus for sportboards with a varying width, which apparatus provides a means to stably and securely store a sportboard, is adaptable to different sizes of sportboards, and is simple to manufacture, install and use. The apparatus is particularly useful for the storage of snowboards and skis.

The apparatus of this invention will store any sportboard with a tapered section that results in the board having at least two different widths, a minimum width and a maximum width, along its length. Boards that meet this criterion can be stored by this apparatus, which uses a similar mechanism for all boards which have a varying width. The apparatus is particularly suited and suitable for the storage of generally planar sportboards that are narrower in the middle and wider at one or both ends, such as snowboards and parabolic skis, however it is not intended to be limited to only these types of sportboards.

The sportboard storage apparatus is mountable onto a support surface, and comprises a back member and two gripping members which each have an inner edge that grips an edge of the sportboard. In a preferred embodiment the gripping members are operatively connected to the back member such that the distance between the gripping members can be adjusted and then fixed.

To store a sportboard such as a snowboard in a vertically mounted apparatus according to the present invention, the distance between the two gripping members is first adjusted so that it is greater than the minimum width of the snowboard but less than the maximum width of the snowboard. A narrow part of the snowboard is then inserted between the two gripping members and the board is lowered until the sides of a wider part of the board engages the gripping members. The inner edges of the gripping members grip the edges of the snowboard, thereby holding the board in the apparatus.

In an alternative embodiment of the apparatus which can store two sportboards, such as pair of skis, a center member is attached to the back member about midway between the two gripping members, each of which include a gripping edge facing toward the center member. The center member includes two gripping edges, one of which is positioned facing the gripping member on one side and the other of which faces the gripping member on the other side. To store a pair of skis, the narrow part of one of the skis is inserted between the center member and one of the gripping members and the ski is lowered (in a vertically mounted apparatus) until the sides of the ski engage against and are held by the gripping edges of the center member and the gripping member on one side. The other ski is similarly mounted between the center member and the gripping member on the other side.

In yet another embodiment the apparatus is convertible between an apparatus that holds only one sportboard and one that holds two sportboards, simply by the removable attachment of a center member.

It is preferred that the distance between the gripping members be adjustable, as described above, because this renders the apparatus adaptable to sportboards of various sizes. In an alternative embodiment of the invention, the distance between the gripping members is not adjustable, limiting the use of an apparatus made to use with sportboards having certain minimum and maximum diameters.

In another preferred embodiment of the invention, the edges of the gripping and center members are angled, such that there is less than a 90 degree angle between these edges and the front face of the back member. In another embodiment of the invention, the edges of the gripping and center members comprise a compressible member. Both of these embodiments function to grip the sportboard and hold it in the apparatus.

In another preferred embodiment, the gripping and center members have edges that are curved along their longitudinal axis, to approximate the taper of the part of the sportboard that is in the apparatus. This feature increases the amount of contact between the edges of the sportboard, and the edges of the gripping and/or center member, thereby increasing the force with which the sportboard is held in the apparatus.

DETAILED DESCRIPTION OF PREFERRED EMBODIMENTS

Figure 1:
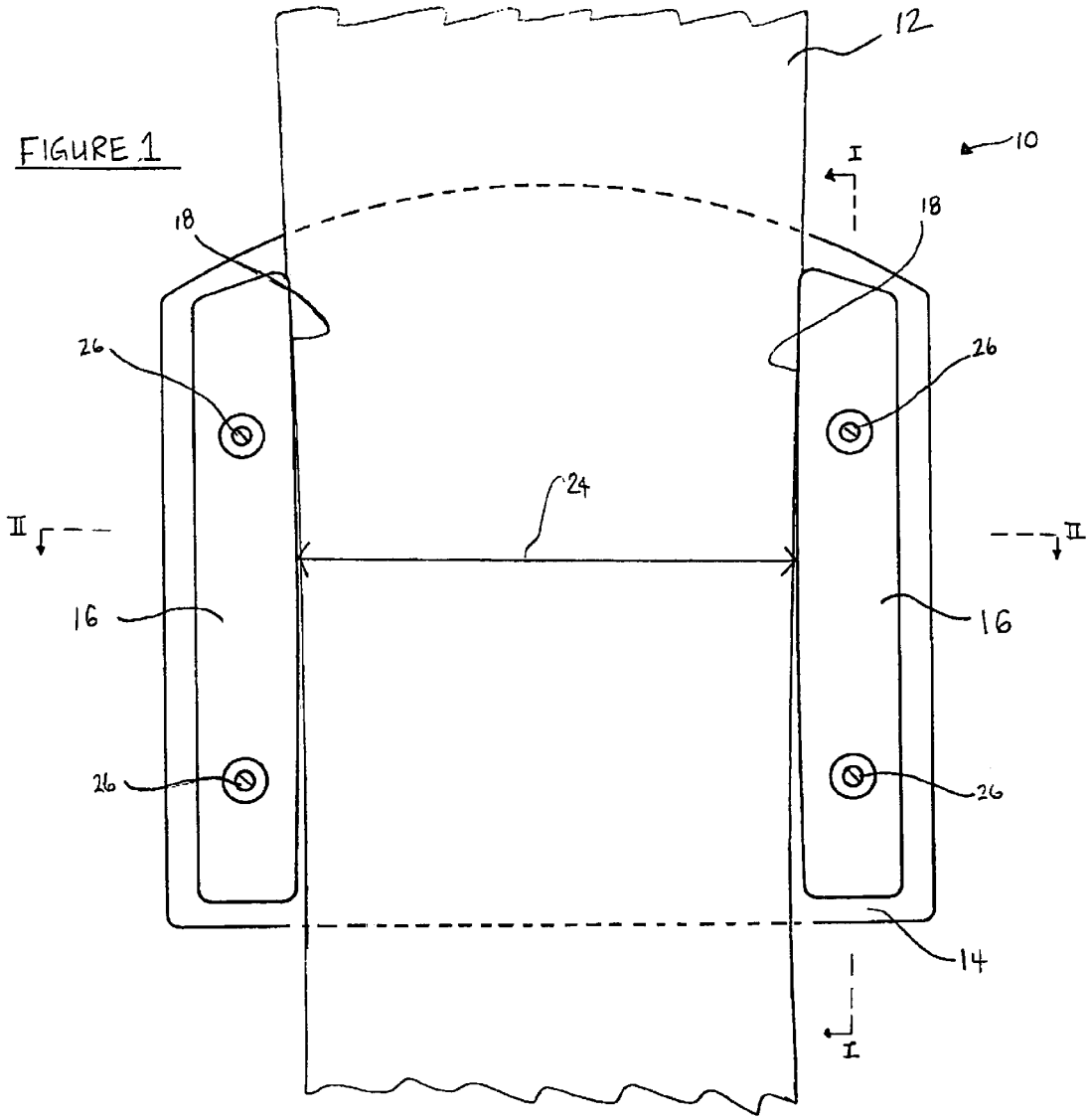
FIG. 1 is a front elevation view of an embodiment of the sportboard storage apparatus, with a snowboard inserted therein.

FIGS. 1 to 4B show an embodiment of the sportboard storage apparatus 10 of this invention, with a snowboard 12 mounted therein. Apparatus 10 comprises a back member 14 and two gripping members 16, each with a gripping edge 18.

Back member 14 of this embodiment is essentially planar, with four apertures 20 for accepting mounting screws or nails, to mount the back member onto a support surface such as a wall or a door. Mounting screws or nails that are used in apertures 20 are preferably countersunk into front surface 40 (FIG. 4B) of back member 14, so that the mounting screw or nail will not protrude above the front surface and interfere with the movement of gripping members thereover. The size of the enlargement for countersinking the mounting screws or nails is indicated by space 21 in FIG. 2 or FIG. 6. The number and location of apertures 20 can be varied, as long as they collectively function to secure back member 14 to the support surface. Alternatively, apertures 20 may extend only partially through back member 14, or they may be mounted upon back member 14, for instance as a metal attachment with an aperture therein for mounting.

Figure 2:
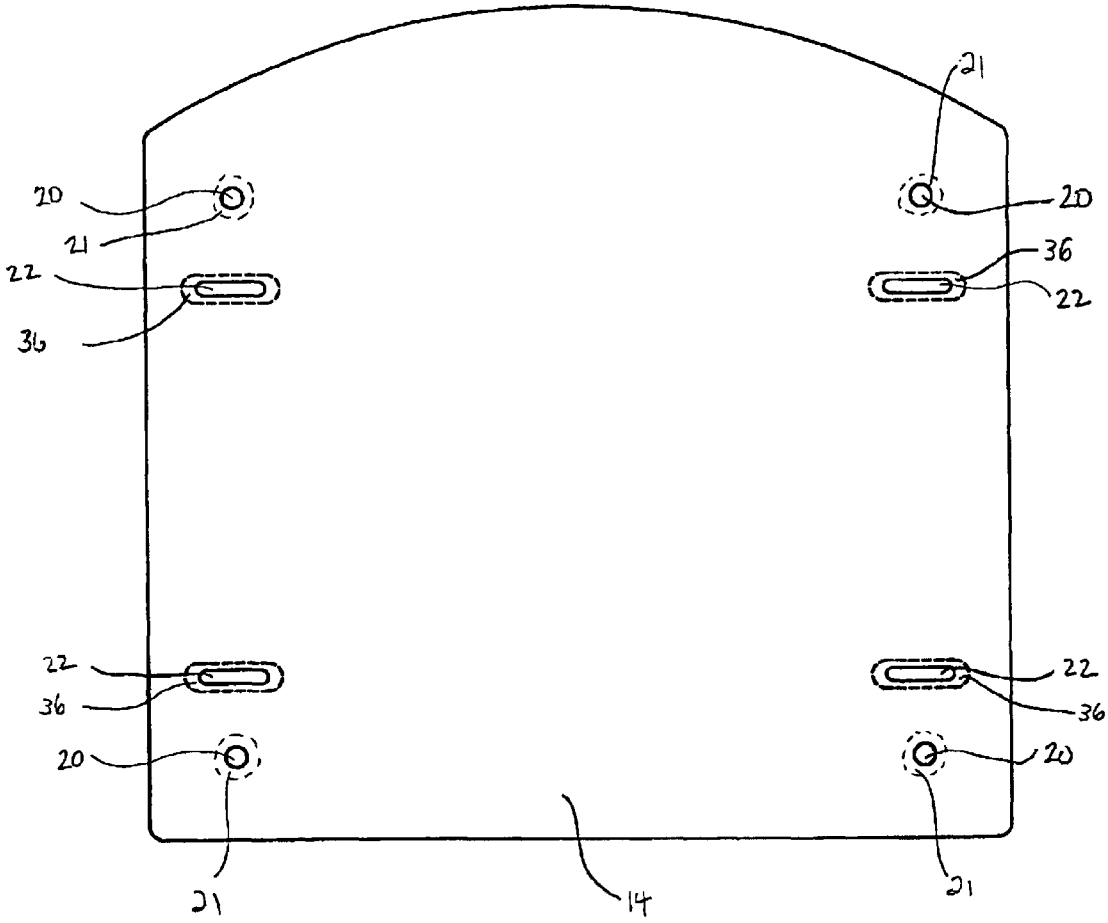
FIG. 2 is a front elevation view of the back member of the embodiment shown in FIG. 1 with the gripping members removed.

FIG. 2 shows four adjustment openings 22 on back member 14, which function both to secure gripping members 16 to back member 14, and also to permit the position of gripping members 16 to be adjusted, such that the distance between them can be increased or decreased according to the size of the board that is to be stored in the apparatus. In the embodiment shown, the adjustment opening is a slot that extends through back member 14. However, alternative adjustment openings such as for example, a slot that only partially penetrates the back member, or a metal slot or other device that is attached to the front surface of back member 14 are intended to be included in this invention.

Gripping members 16 are positioned on back member 14 such that the gripping edges 18 of gripping members 16 are separated by a pre-determined distance 24. Gripping members 16 are preferably elongate and planar, as shown in FIG. 1. In the embodiment shown in FIGS. 1–4, gripping edges 18 are curved when progressing from the top to the bottom of apparatus 10, such that the widest part of each gripping member 16 is the midsection. This curvature mimics the curvature of the part of the snowboard that is inserted in apparatus 10 and therefore gripping edge 18 provides more surface contact with the edge of the snowboard than would a flat gripping edge, which surface contact aids in holding the snowboard in the apparatus. However, although desirable, the curvature of gripping edge 18 is not an essential feature of the invention, as a straight gripping edge 18 would function in apparatus 10 as well.

Although gripping members 16 are shown as elongate, planar structures in FIGS. 1–4, other shapes and sizes of gripping members, if they have a gripping edge, and hold a sportboard according to the principles disclosed in this invention, are intended be included herein.

Figure 4A:
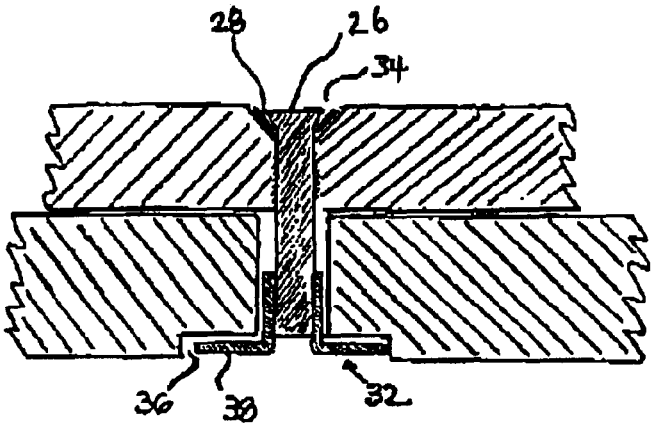
FIG. 4A is a partial cross section taken along line I—I of FIG. 1 to demonstrate how the gripping members and back member are connected together.
Figure 4B:
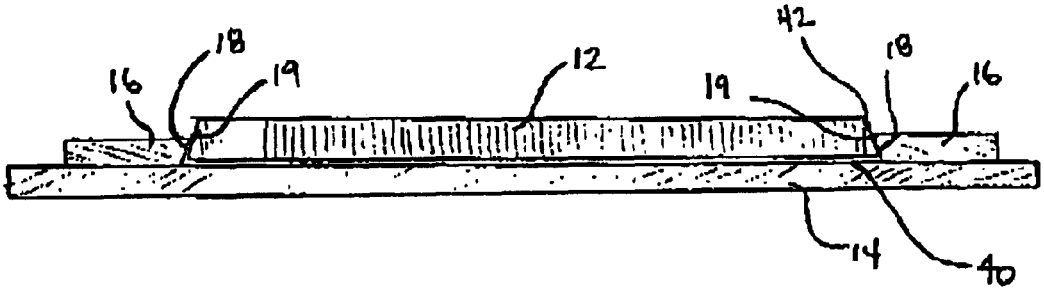
FIG. 4B is a cross section taken along line II—II of FIG. 1.

FIG. 4B, which is a cross-section of FIG. 1 taken at line II—II, demonstrates another feature of gripping edge 18 which is particularly useful when apparatus 10 is mounted substantially vertically. In a preferred construction of gripping members 16, gripping edge 18 converges with the front surface 40 of back member 14, at a less than 90 degree angle. This angle between gripping edge 18 and front surface 40 enables the gripping members to engage the edges 19 of snowboard 12, to keep it from falling out of an apparatus 10 that is substantially vertically mounted. FIG. 4B also demonstrates that the angle on gripping edge 18 is ideally selected to be complementary to edge 19 of snowboard 12, such that both edges 18 and 19 would have maximum contact with one another along their entire width. However, this is not necessary. Edge 18 need simply be angled sufficiently such that some part of it will catch and grip some part of edge 19 of snowboard 12, to keep it from falling out of apparatus 10. To hold a snowboard that does not have an edge that is angled, or on which edge 19 has only a very slight angle, gripping edge 18 would simply have to be sufficiently wide to extend beyond the top corner 42 of the edge of snowboard 12. As is appreciated, rather than, or in addition to, angling edge 18, a similar gripping function could be obtained in a number of ways, for example by forming a lip along gripping edge 18, or by making gripping edge 18 convex.

In an alternative embodiment, gripping edge 18 is at a substantially right angle to surface 40 of back member 14, and is covered with a compressible member such as a rubber or foam gasket, which holds snowboard 12 in place by compression of the compressible member by edge 19 of the snowboard. As is appreciated, edge 18 could be angled or otherwise formed as described in the previous paragraph, and in addition have a compressible member attached thereto. As is also appreciated, only one of the gripping edges 18 need be formed, as described in the preceding paragraphs, to prevent a board from falling out of the apparatus.

For the storage of a sportboard in apparatus 10, distance 24 between gripping members 16 must be greater than the minimum width of the sportboard but less than the maximum width of the sportboard. A snowboard 12 is stored in apparatus 10 by inserting a narrow part of the snowboard between the gripping edges 18 and then wedging the snowboard between the gripping edges by contacting the gripping edges with a wider part of the snowboard. In an apparatus that is vertically mounted, as shown in FIGS. 1–4, the wedging is accomplished by lowering the board until the edges of a wider part of the board engage the gripping edges, at which point downward movement of the snowboard ceases.

In one embodiment of this invention, distance 24 is fixed at the point of manufacture, or by the end user, and cannot be adjusted. In the embodiment shown in FIGS. 1–4, which is preferred, distance 24 is adjustable by the end user of the apparatus.

Figure 3:
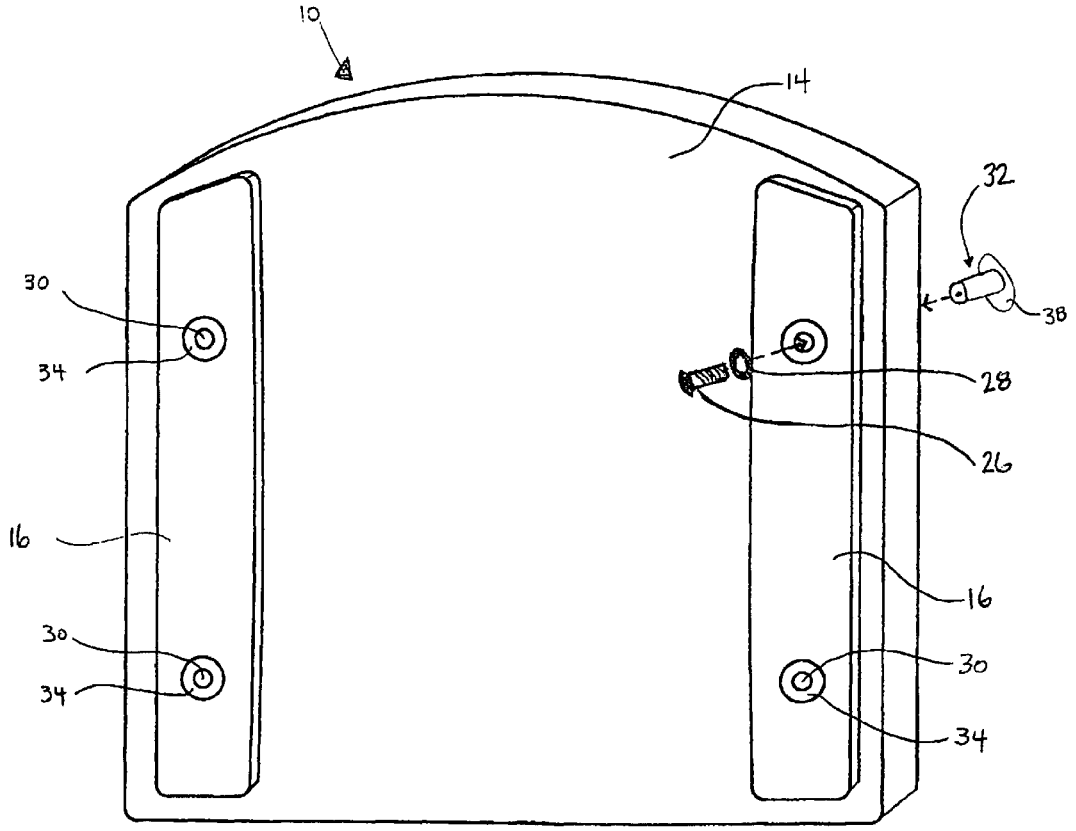
FIG. 3 is an exploded front perspective view of the embodiment shown in FIG. 1, demonstrating how it is assembled.

FIGS. 3 and 4 demonstrate how gripping members 16 and back member 14 may be connected, in order to allow movement of gripping members 16 to increase or decrease distance 24. An adjustment screw 26 is inserted through a gasket 28 and then through an aperture 30 in gripping member 16, and adjustment opening 22 in back member 14, before being threaded into a T-bolt 32. Four screws and T-bolts are used in the embodiment shown in FIGS. 1–4. T-bolt 32 has a flange 38, and is slideably mounted within adjustment opening 22.

Gasket 28 functions in one aspect to protect gripping member 16 from wear and tear from the head of screw 26, as screw 26 is tightened and loosened. Gasket 28 may also prevent screw 26 from slipping through aperture 30. Finally, gasket 28 functions to pull gripping member 16 towards back member 14, as screw 26 is threaded into T-bolt 32. Gasket 28 may be attached to the head of screw 26, or may be omitted altogether, if the head of screw 26 is sufficiently large to perform the functions of gasket 28.

Screws 26 and T-bolts 32 are preferably countersunk in gripping members 16 and back member 14 respectively, so as not to protrude above either the front or back surface of apparatus 10. This countersinking enables apparatus 10 to lie flush against the support surface and prevents protrusion of screw 26 above the front surface of apparatus 10, where it may be caught by, for instance by the clothing of, persons passing by the apparatus. The size of the enlargement for countersinking screws 26 is indicated by space 34 in FIG. 3, and the size of the enlargement for countersinking T-bolt 32 is indicated by space 36 in FIG. 2. Although a preferred feature, countersinking of screws 26 and T-bolts 32, is not an essential element of the invention.

Screw 26 and T-bolt 32 confine one another in adjustment opening 22. Adjustment opening 22 functions, therefore, to guide and limit the movement of screw 26 which in turn guides and limits the movement of gripping member 16 relative to back member 14. If a greater or lesser range of movement of gripping member 16 is desired, adjustment opening 22 need simply be made longer or shorter. As is appreciated, adjustment openings 22 could be positioned on gripping members 16, so that rather than sliding in an opening in back member 14, screw 26 slides in an opening in the gripping member. This embodiment of the invention is intended to be included herein.

FIG. 4A shows a cross section taken along line I—I in FIG. 1, to demonstrate how screw 26 and T-bolt 32 interact to reversibly pull gripping member 16 and back member 14 towards one another. As screw 26 is threaded into T-bolt, the forces created on flange 38 and gasket 28 cause back member 14 and gripping member 16 to move towards one another. When screw 26 is tightened sufficiently, back member 14 and gripping member 16 cannot move relative to one another. To position or reposition gripping member 16, screw 26 is loosened until gripping member 16 can slide relative to back member 14. When gripping member 16 is positioned as desired by the end user, screw 26 is tightened once again.

As is appreciated, in the embodiment shown in FIGS. 1–4B, gripping members 16 and back member 14 will remain operatively connected during adjustment of distance 24. However, continued operative connection is not a necessary feature of the invention, and the invention is intended to include an embodiment wherein gripping members 16 actually dissociate from back member 14 during the adjustment process. For instance, adjustment may be accomplished by a stepped series of pegs and holes, rather than a sliding of one member relative to the other.

Often, gripping members 16 will be positioned such that they are substantially parallel to one another. However, another feature of this embodiment of the invention will allow the end user to position the gripping members such that they are angled slightly to accommodate the curvature of the board. Therefore, the distance between gripping members 16 at the top of apparatus 10 (as shown in FIG. 1) may be set to be greater than the distance between the gripping members at the bottom of the apparatus. This arrangement would be used to more precisely mimic the curvature of the part of the snowboard that is inserted in apparatus 10, and thereby increase the amount of contact between gripping edges 18 and the edges of the snowboard.

Although the embodiment in FIGS. 1–4 has been described in relation to its use to hold a snowboard, the principles are equally applicable to skis or other sportboards that have curved side edges.

Figure 5:
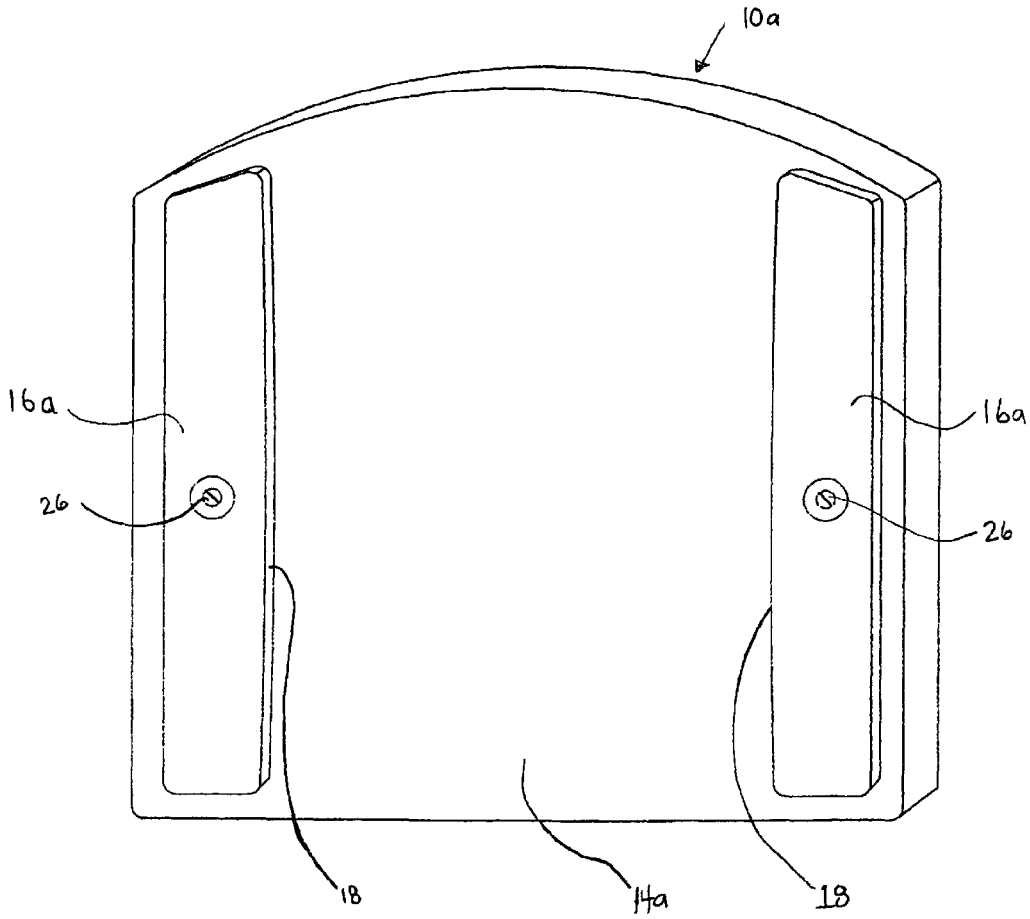
FIG. 5 is a front perspective view of an alternative embodiment of the apparatus in which only one screw per gripping member is used.
Figure 6:
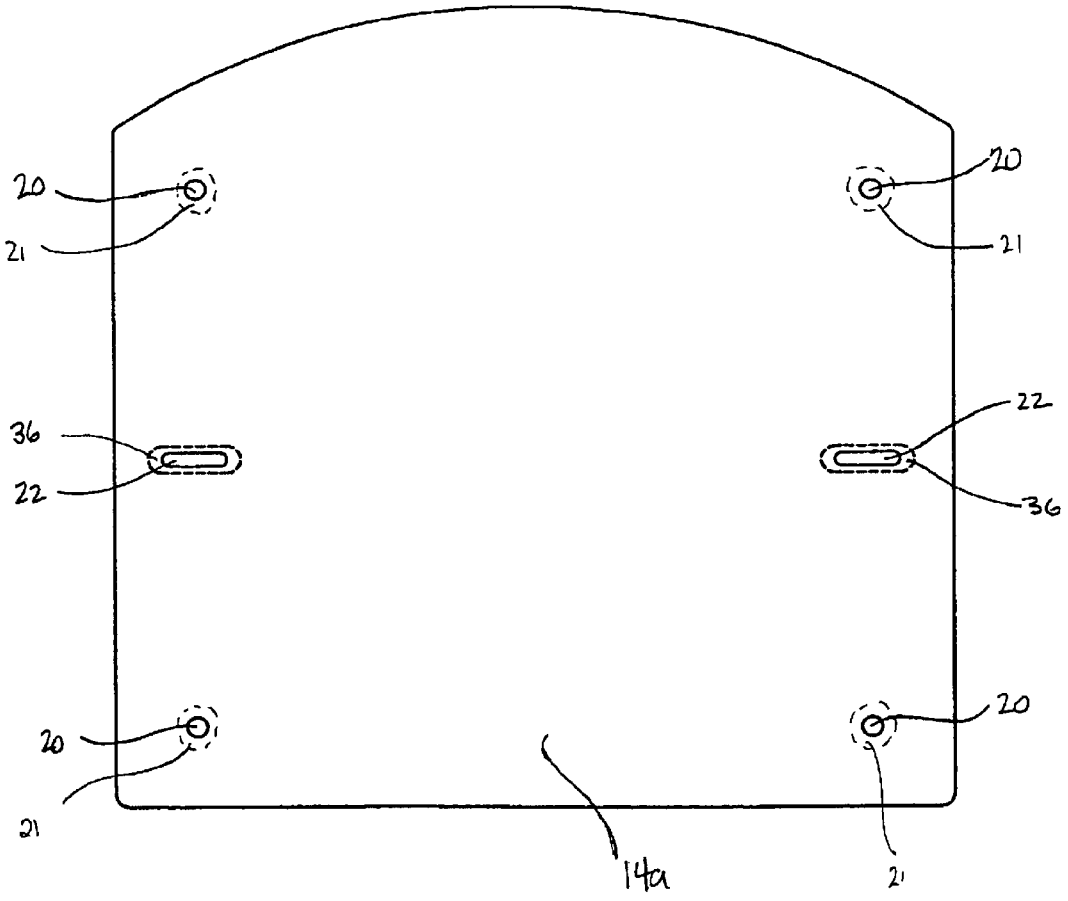
FIG. 6 is a front elevation view of the back member of the embodiment shown in FIG. 5, with the gripping members removed.

FIGS. 5 and 6 show apparatus 10*a*, an alternative embodiment of the invention in which back member 14*a* is attached to each gripping member 16*a* by only one screw 26, rather than two. Back member 14*a* has only two adjustment openings 22 to receive screws 26. In other respects, apparatus 10*a* is similar to and functions on the same principles as apparatus 10. One particular advantage of apparatus 10*a* is that because gripping members 16*a* are attached to back member 14*a* by only one screw 26 each, they are able to pivot on screw 26. Therefore, apparatus 10*a* can be mounted to a support surface after gripping members 16*a* are attached to back member 14*a*, which makes assembly and mounting of the apparatus more simple than in the case of the embodiment shown in FIGS. 1–4, wherein gripping members cover apertures 20. Note however, that apertures 20 need not be placed underneath gripping members 16 in apparatus 10, but rather maybe positioned elsewhere on back member 14. Additionally, because gripping members 16*a* can pivot in apparatus 10*a* they are able to adjust to the curvature of the edges of the part of the snowboard that is inserted into the apparatus, as it is inserted into the apparatus, to maximize the amount of contact between the edges of the snowboard and gripping edges 18. In this regard, screws 26 would be threaded into T-bolt 32 with sufficient torque to prevent, along with the frictional forces between back member 14*a* and gripping member 16*a*, gripping members 16*a* from being driven apart when a board is placed there between.

In the embodiments shown in FIGS. 1–6, both gripping members may be adjusted, to enable the end user to set distance 24. However, it is appreciated that distance 24 may be adjusted by the end user if one gripping member is fixed, for example by glue, nails, screws or staples, and the other gripping member is adjustable. This embodiment is intended to be included herein.

FIG. 7 shows apparatus 10*b*, an alternative embodiment of this invention that will hold two sportboards, such as a pair of skis. In this embodiment, gripping members 16*b* are the same as gripping members 16*a* and function on the same principles. Apparatus 10*b* has an additional center member 44 that is attached in a predetermined position to back member 14*b*. FIG. 7 shows the preferred means of attachment of center member 44, using screws 46 that pass through apertures in center member 44 and into back member 14*b*. Note that because center member 44 is affixed by screws in embodiment 10*b*, it is removable from the apparatus. Once the center member is removed, apparatus 10*b* could be used to store one larger sportboard between gripping members 16*b*. Any other means of removably attaching center member 44 are intended to be included herein.

In an alternative embodiment, center member 44 is permanently attached to back member 14*b*, for example with glue, nails or staples.

Center member 44 has two gripping edges 48. One gripping edge 48 faces the gripping edge 18 on one side of center member 44, and the other gripping edge 48 faces the gripping edge 18 on the other side of center member 44. Therefore, two sportboards can be inserted into apparatus 10*b*, one on either side of center member 44.

Figure 7A:
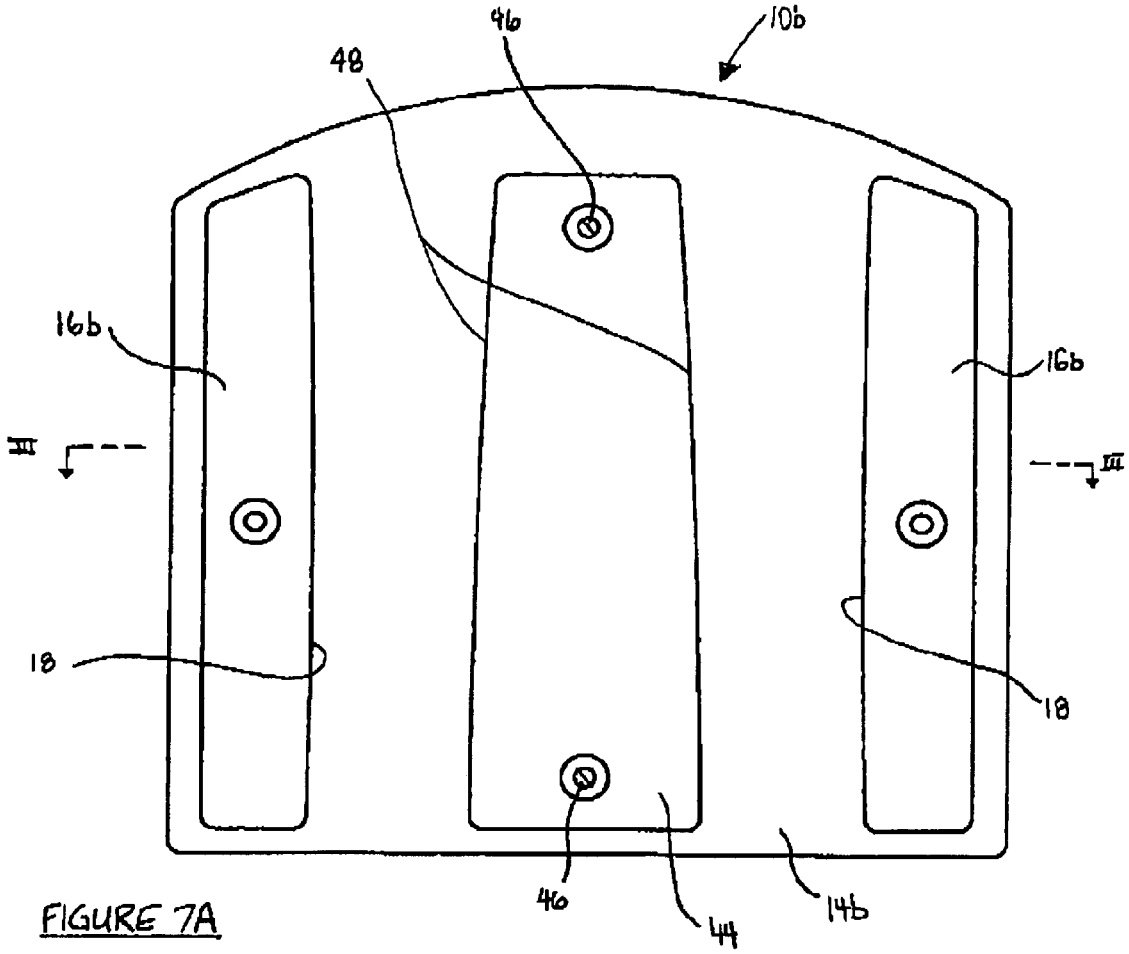
FIG. 7A is a front elevation view of an alternative embodiment of the apparatus that holds a pair of skis.

In the embodiment shown in FIG. 7A, center member 44 is shaped so that the width of the top portion (as seen in FIG. 7) is narrower than the width of the bottom portion, with a resulting curvature to gripping edges 48 of center member 44. This results in a gradual narrowing of the opening between either gripping member 16*b* and center member 44, progressing from top to bottom. This narrowing mimics the shape of the portion of a curved ski that would be in the apparatus, being wider on the top than on the bottom and would therefore aid in holding the ski in the apparatus, because it would increase the amount of contact between the gripping edges 48 and 18, and the edges of the ski. However, the curvature it is not an essential feature of the invention, as a straight gripping edge 48 would function in apparatus 10*b* as well.

Figure 7B:
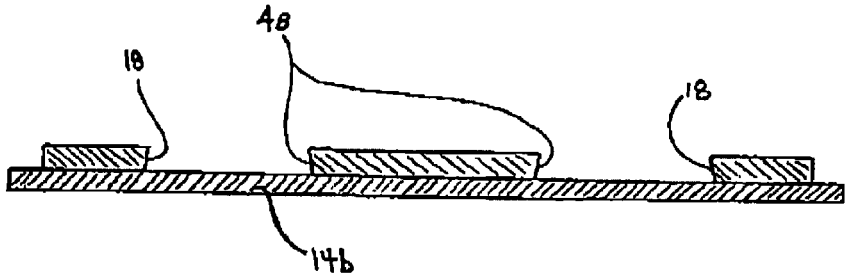
FIG. 7B is a cross sectional view, taken at line III—III in FIG. 7A.

Gripping edges 48 may embody some or all of the features described above for gripping edges 18, which features enable the edges to hold a sportboard and to keep it from falling forward out of a vertically mounted apparatus 10*b*. FIG. 7B shows a cross section of apparatus 10*b* taken along line III—III of FIG. 7A, which shows that in this embodiment edges 48 are angled, as described above for edges 18.

The position of gripping members 16*b* on back member 14*b* can be adjusted, as described for gripping members 16 and 16*a*. Therefore, the distance between gripping edges 18 and 48 on both sides of the center member can be adjusted to suit the size of sportboard that is to be stored therein. As each side is independently adjustable, sportboards of different sizes may be stored in apparatus 10*b*. In an alternative embodiment, the position of one of gripping members 16*b* is fixed and center member 44 is adjustable. In yet another embodiment, the position of both gripping members 16*b* and center member 44, are adjustable.

In the embodiments described herein the distance between gripping edges is adjustable, which is preferred, because then one apparatus as purchased by the end-user, or as manufactured, is adaptable to differently sized sportboards. However, alternative embodiments in which the distance between the gripping edges is fixed, are intended to be included herein. Additionally, in such embodiments the entire apparatus may be constructed as one unit rather than as separate parts that are connected together.

While the invention has been described with reference to specific embodiments thereof, it will be appreciated that numerous variations, modifications and embodiments are possible and all such variations and embodiments are to be regarded as being within the spirit and scope of the invention.

What is claimed is:

1. A sportboard storage apparatus for holding a sportboard with a minimum width and a maximum width that differ and a curved edge on each side, comprising:

(a) a back member, with a front surface and a back surface;

(b) two gripping members connected to the back member; and (c) a gripping edge on each gripping member, providing a sportboard edge engaging surface said gripping edges substantially facing one another and each gripping edge being convexly curved along its longitudinal axis, and said ongoing edges being separated a distance to wedge the sportboard therebetween.

2. The apparatus of claim 1 adapted to be mountable onto a solid surface.

3. The apparatus of claim 1 sized to hold a snowboard between the gripping edges.

4. The apparatus of claim 1 size a ski between the gripping edges.

5. The apparatus of claim 1 wherein the distance between the gripping members can be adjusted.

6. The apparatus of claim 1 wherein the back member defines one or more width adjustment openings.

7. The apparatus of claim 1 wherein the back member defines either one, two or four width adjustment openings.

8. The apparatus of claim 1 wherein at least one gripping member defines at least one width adjustment opening.

9. The apparatus of claim 1 wherein at least one gripping member defines either one or two width adjustment openings.

10. The apparatus of claim 1 wherein at least one of the gripping edges converges with the surface of the back member at less than a 90 degree angle.

11. The apparatus of claim 1 wherein at least one of the gripping edges comprises a compressible member.

12. The apparatus of claim 11 wherein the compressible member is rubber or foam.

13. The apparatus of claim 1 wherein at feast one gripping member is pivotable.

14. A sportboard storage apparatus for holding two sportboards each with a minimum width and a maximum width that differ and a curved edge on each side, comprising:

(a) a back member with a front surface and a back surface;

(b) a first gripping member and a second gripping member connected to the back member;

(c) a first gripping edge on the first gripping member and a second gripping edge on the second gripping member, said first gripping edge substantially facing said second gripping edge;

(d) a center member connected to the back member approximately midway between the first gripping member and the second gripping member; and (e) a first center member gripping edge and a second center member gripping edge on the center member, the first center member gripping edge being on one side of the center member and facing the first gripping edge, and the second center member gripping edge being on the other side of the center member and facing the second gripping edge, each gripping edge being convexly curved along its longitudinal axis, and the first center member gripping edge and the first gripping edge, being separated a distance to hold one sportboard therebetween, and the second center member gripping edge and the second gripping edge being separated a distance to hold the other sportboard therebetween.

15. The apparatus of claim 14 sized to hold a pair of skis in the apparatus.

16. The apparatus of claim 14 wherein the center member is removably connected to the back member.

17. The apparatus of claim 14 wherein the distance between the center member and each gripping member can be adjusted.

18. The apparatus of claim 14 wherein the back member defines one or more width adjustment openings.

19. The apparatus of claim 14 wherein the back member defines either one, two or four width adjustment openings.

20. The apparatus of claim 14 wherein at least one gripping member defines at least one width adjustment opening.

21. The apparatus of claim 14 wherein at least one gripping member defines either one or two width adjustment openings.

22. The apparatus of claim 14 wherein the center member defines one or more width adjustment openings.

23. The apparatus of claim 14 wherein at least one of the first gripping edge, the second gripping edge or a center member gripping edge converges with the surface of the back member at less than a 90 degree angle.

24. The apparatus of claim 14 wherein at least one of the first gripping edge, the second gripping edge or a center member gripping edge, comprises a compressible member.

25. The apparatus of claim 24 wherein the compressible member is rubber or foam.

26. The apparatus of claim 14 wherein at least one gripping member is pivotable.

* * * * *